US006415890B1

(12) United States Patent
Tucker et al.

(10) Patent No.: US 6,415,890 B1
(45) Date of Patent: Jul. 9, 2002

(54) PADDED LADDER PROTECTOR

(76) Inventors: James Dale Tucker, 7395 SE. Craig St., Hobe Sound, FL (US) 33455; Dennis Michael Dale, 144 Pinewood Ct., Jupiter, FL (US) 33458

( * ) Notice: Subject to any disclaimer, the term of this patent is extended or adjusted under 35 U.S.C. 154(b) by 0 days.

(21) Appl. No.: 09/598,626

(22) Filed: Jun. 21, 2000

(51) Int. Cl.[7] ..... E04G 1/00; A47B 95/00
(52) U.S. Cl. ..... 182/129; 248/345.1
(58) Field of Search ..... 182/129; 248/345.1

(56) References Cited

U.S. PATENT DOCUMENTS 5,673,768 A * 10/1997 Schmitt et al. ..... 182/129
5,695,870 A * 12/1997 Kelch et al. ..... 428/318.4

* cited by examiner

*Primary Examiner*—Daniel P. Stodola
*Assistant Examiner*—Hugh B. Thompson
(74) *Attorney, Agent, or Firm*—McHale & Slavin

(57) ABSTRACT

The padded ladder protector is an easily attachable and detachable device for mounting on edges of a ladder to cushion and protect the user from injury. The protector is made of a foamed polymer with an adhesive surface covered by a peel strip. By removing the peel strip, the protector may be temporarily attached to edges of the rungs or tray or other parts of the ladder as desired by the user. After a specific use, the protector can be easily removed and another protector may be placed on the same parts or other parts of the ladder. The protector may also be adhesively attached to a rigid support which can be attached to the ladder.

2 Claims, 3 Drawing Sheets

PADDED LADDER PROTECTOR

FIELD OF THE INVENTION

This invention relates generally to the construction or modification of conventional ladders and more particularly to a device for use with ladder edges to protect an individual using the ladder.

BACKGROUND OF THE INVENTION

The various types of ladder constructions are well known. Conventional ladders may be constructed of wood, aluminum, or the like rigid material. As commercially produced, the styles are fairly similar and typically consist of an A-type frame having rungs between opposing side members for standing upon.

In many trades, the use of a ladder is mandatory in order to reach raised items for retrieval or while working upon. Should an individual be required to stand on a ladder for any length of time, such as the case with painters, plumbers, or the like skilled craftsmen, the individual may lean against the rungs causing an uncomfortable pressure against the body, or even injury.

By way of example, an experienced painter often experiences pain to their legs while using a ladder. Typically the painter has acquired a stable stance but due to the repetitive use of the stance, any rung that impacts the body leaves a pressure point. Additionally, the ladder may scratch, mar, or in some other way injure other areas of an individual or even a wall or floor of which it is in contact with while being assembled/disassembled. Should the user of the ladder take a misstep an impact their shins, the result is immediate injury to the individual.

DESCRIPTION OF THE PRIOR ART

U.S. Pat. No. 2,518,107 discloses an attachable shin shield for stepladders which is secured to the ladder rungs by a pair of brackets, and is particularly constructed to be compatible with wooden rung ladders.

U.S. Pat. No. 6,006,863 discloses a method for forming a ladder having rungs constructed and arranged to include a foam protective pad. The problem with this design is that it requires the purchase of an entirely new ladder for one to avail themselves of the foam protective improvement. The '863 patent includes the padding on every rung which is impractical since only certain rungs would be desirably protected at the discretion of the end user. Additionally, there is no ability afforded by the patent to cushion the ladder at its points of contact with adjacent surfaces upon which it might be positioned during use.

U.S. Pat. No. 5,692,581 discloses a detachable anti-slip device for ladder rungs. The anti-slip mechanism fails to provide a protective function to the end user or to adjacent surface areas with which the ladder might come into contact.

Thus, the prior art fails to teach or suggest, when viewed singularly or in combination, a device for providing readily attachable and detachable protective cushioning for providing a protective and/or padding effect which affords protection to the end-user and to the surrounding environment of use.

SUMMARY OF THE INVENTION

The present invention relates to a readily detachable or durably attached padded protective device for ladders. The protective device is a foam strip having a sufficient density to provide a desirable degree of protection and including therewith a contiguous attachment means for providing a mechanical bond to various portions of the ladder or similar devices used for climbing including stools, stairs, gangways, or the like.

The padding utilized in the device is preferably composed of a closed-cell, cross linked polyethylene, polyethylene/EVA foam, such as MICROCELL, MINICEL, STRATOCELL, or CELLUPLANK. Such materials are often referred to as super dense foam materials. Illustrative forms of the attachment means may include an adhesive strip (which may include a peelable cover strip removable prior to attachment), adhesively mounted hook and loop fastener means, mechanical fastener, e.g. a nut and bolt, deformable rivet, e.g. plastic rivets designed to pressure fit within a preformed opening, or the like equivalent attachment means. The protective padding/cushioning may be attached to the rungs or edges of a ladder to prevent injury to (1) the user from leaning against it during use, (2) the surface edges which it comes into contact with such as walls and floors, and (3) the ladder itself.

Accordingly, it is an objective of the instant invention to provide a padding/cushioning device useful for protecting the various surfaces of a climbing device, such as the rungs, legs, and adjacent portions of a ladder.

It is a further objective of the instant invention to provide a padding/cushioning device that is repositionable, replaceable, and/or cleanable.

It is yet another objective of the instant invention to provide a padding/cushioning device that is adjustable in size.

It is another objective of the instant invention to provide such a padding/cushioning device in a plurality of sizes and/or profiles.

It is still a further objective of the instant invention to provide a protection kit for padding/cushioning a climbing device.

It is yet an additional objective of the instant invention to provide a method of protecting a ladder.

It is a still a further objective of the invention to provide an inexpensive, readily accessible, easily stored detachable or permanently attachable padded protection device for ladders.

Other objects and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DESCRIPTION OF THE INVENTION

Although the invention will be described in terms of a specific embodiment, it will be readily apparent to those skilled in this art that various modifications, rearrangements, and substitutions can be made without departing from the spirit of the invention. The scope of the invention is defined by the claims appended hereto.

Figure 1:
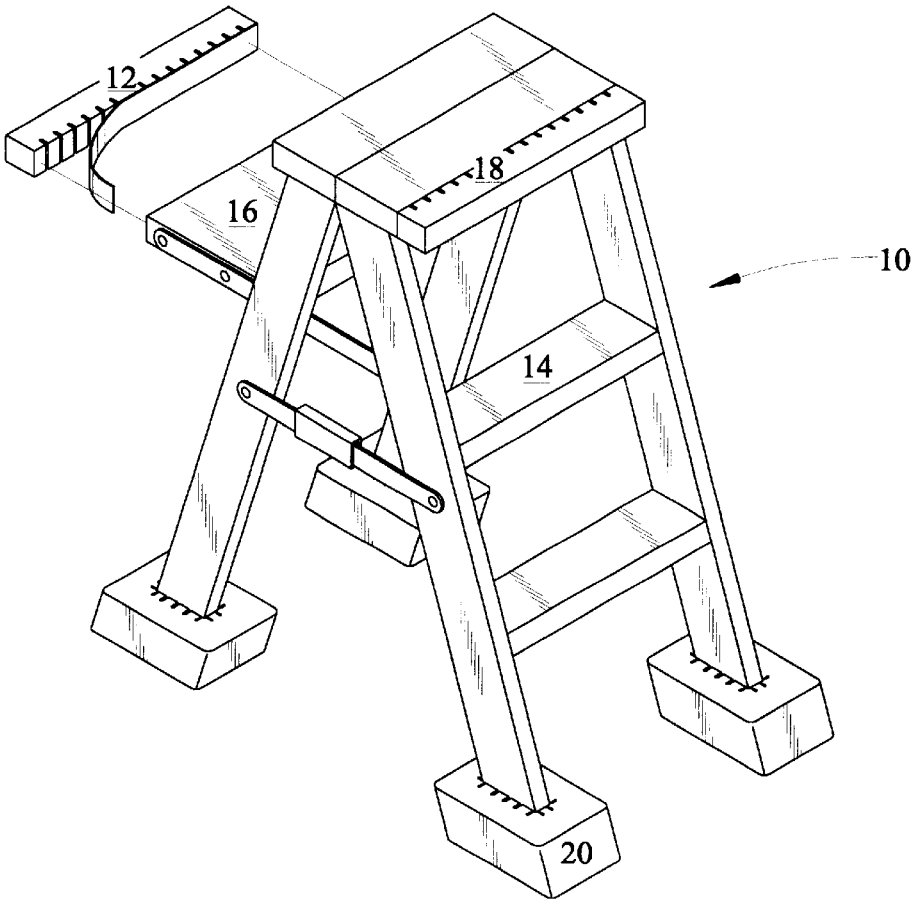
FIG. 1 is a pictorial view of a step ladder depicting the placement of the padded protection device.

Now referring to FIG. 1, shown is a pictorial view of of a step ladder 10 and the attached padded device 12. The device can be attached to the rungs 14 of the ladder to protect the users legs from bruising and injury and to the tray 16, top edge 18, and feet of the ladder 20 to prevent scarring and damage to the walls, floor, or other surface it comes into contact with. Additionally, the ladder 10 itself is protected from wear and tear.

Figure 2:
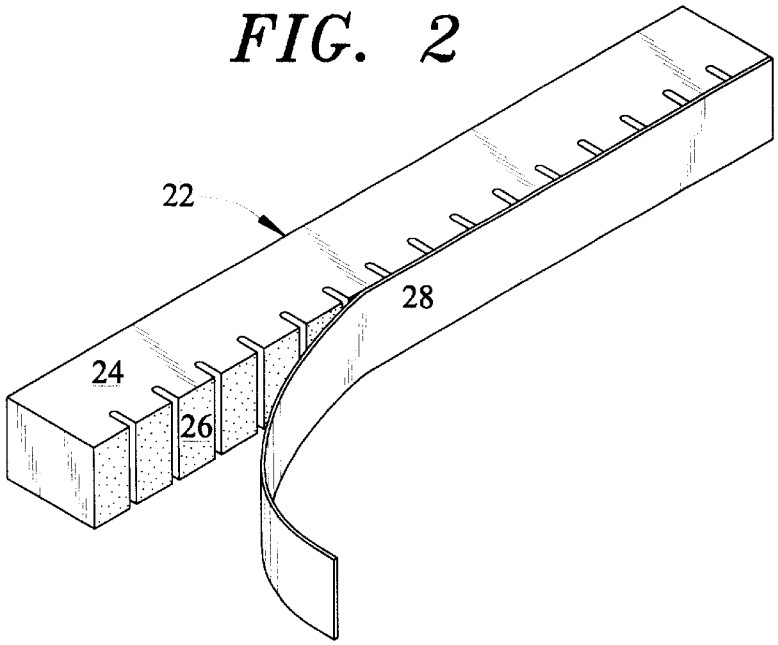
FIG. 2 is a partial cross-sectional view of the semi-permanently attached padded protection device.

Now referring to FIG. 2, the instant invention is shown in a partial cross-sectional view. The elongated layer 2 is constructed and arranged to be of a profile effective to effectively cover and protect the desired surface and thereby provide padding/cushioning; the device must also be of a length effective to extend across the desired surface area. In an illustration, but non-limiting embodiment, elongated layer 20 is approximately 1.25"×1"×10" and is formed from a "super" dense polyfoam material having an outer side 22 and an inner side 24. Although the foam may be sized to cover any suitable portion of the ladder or similar climbing device, it is contemplated that in a preferred embodiment the foam will be sized from about 0.5"×10"×0.75" to about 1"×10"×1.25". Juxtaposed to the inner side 24 is an adhesive material 26 with a peel off outer layer 28. The outer layer 28 can be peeled off to expose the inner adhesive layer 26. The padded device can then be attached to the surface of the ladder by pressing the inner adhesive layer 26 to the ladder surface.

The padded device can also have evenly spaced perforations 29 on the inner side 24 to allow the device to be attached to round surfaces.

Figure 3:
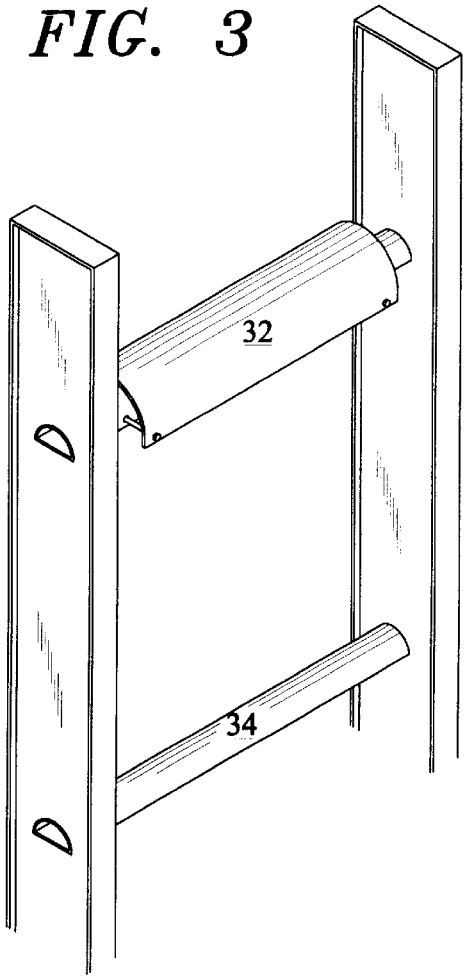
FIG. 3 is a pictorial view of an extension ladder depicting the placement of the padded protection device.

Now referring to FIG. 3, shown is a partial pictorial view of an extension ladder 30 and the detachable, padded device 32. The device 32 can be attached to the rungs 34 of the ladder 30 to provide a padding/cushioning protective effect for the end suer.

Figure 4:
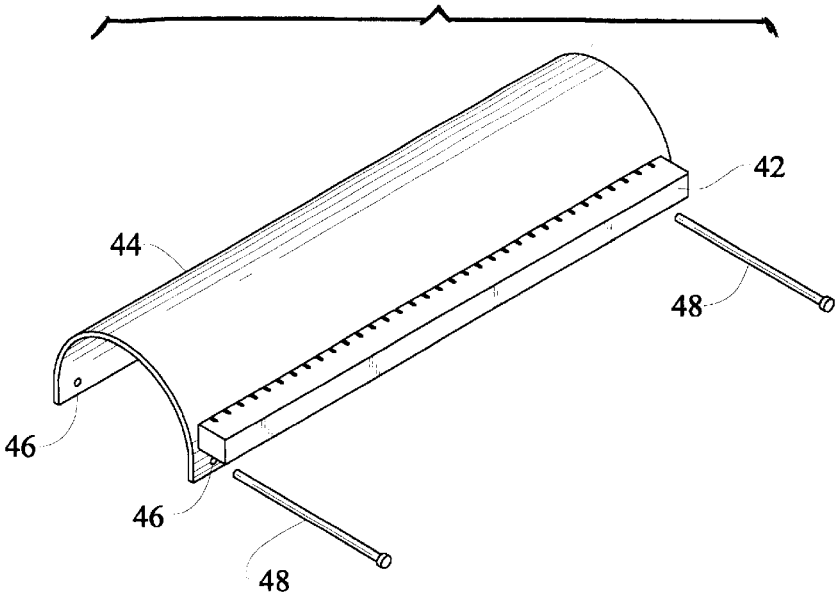
FIG. 4 is a partial cross-sectional view of the detachable padded protection device.

Now referring to FIG. 4, the instant invention is shown in a partial cross-sectional view wherein an elongated suitably dense polyfoam material with an outer side 42 is suitably adhered to the external face 44 of a suitably sized rigid material, e.g. an approximately 4"×10"×1/16" rigid material such as aluminum, plastic, or like material. Apertures 46 are provided at both terminal ends and the device 32 is secured to the rung 30 by a mechanical attachment means, for example, a nut and bolt configuration as illustrated at 48 inserted through the aperture 46.

The device 32 can be easily attached and detached by the nut and bolt means 48 and thus placed upon the rungs 34 of which the user is standing on or leaning against thus providing protection against slipping or bruising.

Figure 5:
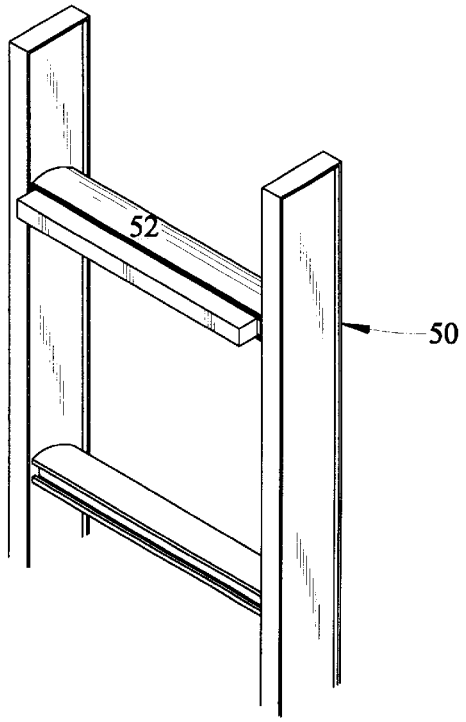
FIG. 5 is a pictorial view of an extension ladder depicting the placement of the padded protection device to the track design.

Now referring to FIG. 5, shown is a partial view of an extension ladder 50 and a slide on protective device 52.

Figure 6:
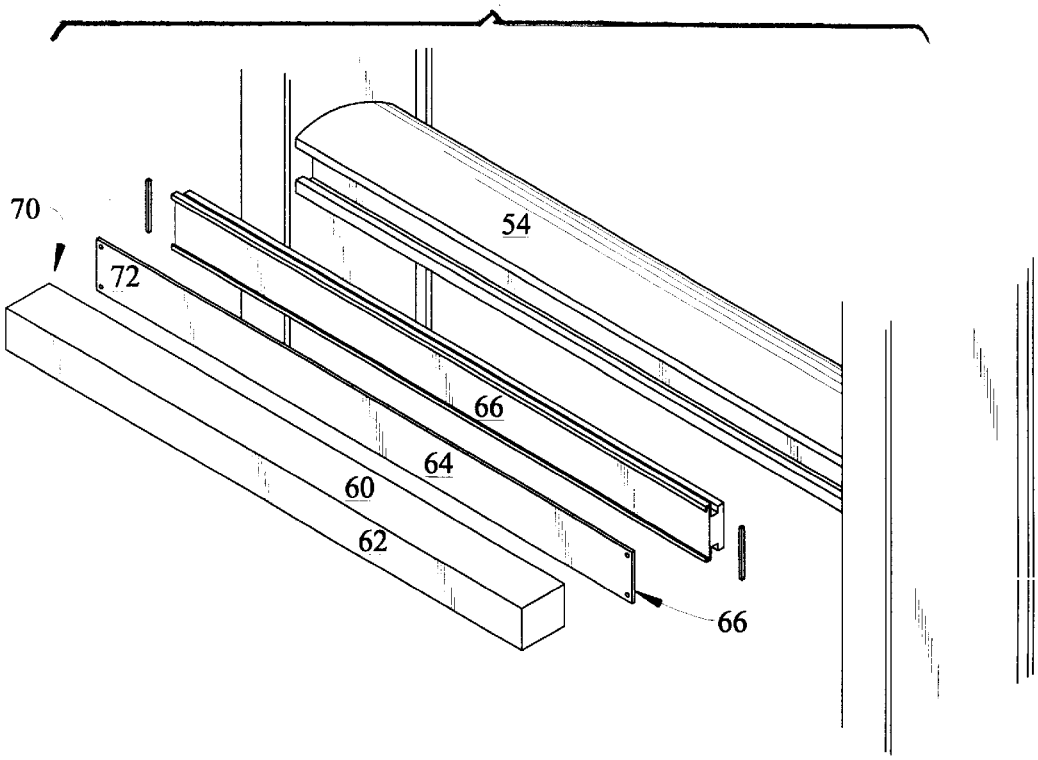
FIG. 6 is a partial cross-sectional view of the track design of an extension ladder depicting the placement of the padded protection device.

Now referring to FIG. 6, the instant invention is shown in a partial cross-sectional view wherein an illustrative embodiment is depicted including layer of super dense polyfoam material with an outer side 62 and an inner side 60 juxtaposed to a 4"×11" by 1/16" rigid material 64 such as aluminum, plastic or other such material. The device 52 is slid into a track device 66 that is attached to the rung of the ladder 54 by a mechanical attachment means, for example, a nut and bolt configuration as illustrated at 70 inserted through the aperture 72.

Alternately, the inner layer 64 may include multiple apertures, e.g. two apertures 66 at both terminal ends with a nut and bolt 68 or equivalent mechanical fastening means capable of being inserted through the aperture 66.

It is to be understood that while a certain form of the invention is illustrated, it is not to be limited to the specific form or arrangement of parts herein described and shown. It will be apparent to those skilled in the art that various changes may be made without departing from the scope of the invention and the invention is not to be considered limited to what is shown and described in the specification and drawings.

What is claimed is:

1. In the combination of a ladder having a plurality of spaced apart rungs connected at each end to elongated legs and a foam protector kit, the improvement comprising an elongated essentially semi-circular rigid material extending along at least one of said rungs, said rigid material having opposed longitudinal edges said elongated rigid material replaceably attached to said at least one of said rungs, a removable cushioning foam material adhesively attached to at least one of said opposed longitudinal edges.

2. In the combination of a ladder having a plurality of rungs connected at each end to elongated legs and a foam protector kit, the improvement comprising an elongated channel shaped track member replaceably attached to at least one of said rungs, a cushioning foam member having an inner side and an outer side, a rigid material attached to said inner side of said cushioning foam, said rigid material being removably telescoped into said elongated channel shaped track member.

* * * * *